US006130592A

United States Patent [19]

Okihara

[11] Patent Number: 6,130,592

[45] Date of Patent: Oct. 10, 2000

[54] ELECTRO-MAGNETIC RELAY AND COVER USED FOR THE SAME

[75] Inventor: Naoto Okihara, Tokyo, Japan

[73] Assignee: NEC Corporation, Tokyo, Japan

[21] Appl. No.: 09/187,980

[22] Filed: Nov. 9, 1998

[30] Foreign Application Priority Data

Nov. 7, 1997 [JP] Japan ..... 9-306072

[51] Int. Cl.[7] ..... H01H 13/04; H01H 9/02

[52] U.S. Cl. ..... 335/202; 174/35 R; 174/35 MS; 206/719; 361/816; 361/818; 361/819

[58] Field of Search ..... 174/35 R, 35 MS, 174/35 GC; 206/719, 720, 721; 200/304, 305; 335/202; 361/816, 818, 819, 799, 753, 800

[56] References Cited

U.S. PATENT DOCUMENTS 5,008,487 4/1991 Shimmyo ..... 174/35 R
5,566,055 10/1996 Salvi, Jr. ..... 361/816

FOREIGN PATENT DOCUMENTS 4-263508 9/1982 Japan .

*Primary Examiner*—Michael L. Gellner
*Assistant Examiner*—Raymond Barrera
*Attorney, Agent, or Firm*—Sughrue, Mion, Zinn, Macpeak & Seas, PLLC

[57] ABSTRACT

There is provided an electro-magnetic relay including (a) a coil assembly including a core, a coil wound around the core, and a magnet located at the center of the coil assembly, (b) an armature block assembly including an armature swingable relative to the core, a spring swingable together with the armature and having a contact at a distal end thereof, and an insulating block formed integral with the armature and the spring, (c) a base assembly including a fixed contact facing to the spring, a fixed contact terminal on which the fixed contact is formed, a neutral terminal to be electrically connected to the spring, a coil terminal to be electrically connected to the coil, and an insulating block formed integral with the fixed contact, the fixed contact terminal, the neutral terminal, and the coil terminal, and (d) a cover housing therein the coil assembly, the armature block assembly, and the base assembly, the cover including (d-1) an enclosure having both a bottom edge defining an open bottom, and an insulating external surface, (d-2) a plurality of projections formed on the bottom edge so that the projections can support the enclosure while the enclosure stands, and (d-3) a shield metal plate covering an inner surface of the enclosure therewith, the shield metal plate having extensions extending along and beyond the projections. The electro-magnetic relay has enhanced shielding characteristic, and as a result, can quickly respond to high frequency input signals.

26 Claims, 9 Drawing Sheets

ELECTRO-MAGNETIC RELAY AND COVER USED FOR THE SAME

BACKGROUND OF THE INVENTION

1. Field of the Invention

The invention relates to an electro-magnetic relay and a cover used therefor, and more particularly to an electro-magnetic relay required to have quick response to high frequency signals, and a cover used therefor.

2. Description of the Related Art

One of conventional electro-magnetic relays is illustrated in FIGS. 1 and 2. With reference to FIG. 1 which is an exploded perspective view of the conventional electro-magnetic relay, the illustrated electro-magnetic relay is comprised of a coil assembly 100, an armature block assembly 200, and a base assembly 300.

The coil assembly 100 includes a core 15 covered with coil spool 11 except opposite ends acting as magnetic poles, a coil 12 wound around the core 15, and a permanent magnet 13 inserted into a hole formed at the center of the coil spool 11, and thus located at the center of the core 15. The coil spool 11 is composed of insulating material.

The armature block assembly 200 includes an armature 20, swingable springs 22*a* and 23*a* each having a contact 22*b* and 23*b* at a distal end thereof, and an armature block 250 made of insulating material and formed integral with the armature 20 and the springs 22*a* and 23*a*. The armature 20 moves like a seesaw by applying a current to the coil 12 or stopping application of a current to the coil 12. In such seesaw movement of the armature 20, a center portion thereof located on the permanent magnet 13 acts as a fulcrum. The swingable springs 22*a* and 23*a* are connected to hinge springs 22 and 23, respectively.

The base assembly 300 includes fixed contacts 30*a* and 31*a* facing to the swingable contacts 22*b*, fixed contacts 32*a* and 33*a* facing to swingable contacts 23*b*, fixed contact terminals 30, 31, 32, and 33 on which the fixed contacts 30*a*, 31*a*, 32*a*, and 33*a* are mounted, neutral terminals 38 and 39, coil terminals 34, 35, 36, and 37, and a box-shaped insulating block (no reference numeral) formed integral with the fixed contact terminals 30, 31, 32, and 33, the neutral terminals 38 and 39, and the coil terminals 34, 35, 36, and 37. The fixed contact terminals 30, 31, 32, and 33 are formed to outwardly project to thereby act as relay terminals.

Ends of the coil 12 are electrically connected to welding portions 11*a* buried in the coil spool 11, and further electrically connected to coil terminals 34, 35, 36, and 37 by welding. The hinge springs 22 and 23 of the armature block assembly 200 are electrically connected to the neutral terminals 38 and 39 of the base assembly 300, respectively, by welding.

FIG. 2 is a perspective view showing how the electro-magnetic relay is assembled. The armature block assembly 200 and the coil assembly 100 are assembled to the base assembly 300. The armature block assembly 200, the coil assembly 100, and the base assembly 300, which are assembled to one another, are covered with a cover 400 made of plastics. Gaps between the cover 400 and the base assembly 300 are filled with electrically insulating sealing material such as epoxy resin. Thus, there is completed the electro-magnetic relay.

The conventional electro-magnetic relay having the above-mentioned structure has a problem of poor response to high frequency signals input to contacts. This is because the cover 400 is made of plastics, and thus, does not have shielding characteristic, which means that it is not possible to match with a transmission path with respect to characteristic impedance.

In order to overcome this problem, Japanese Unexamined Patent Publication No. 4-263508 having been published on Sep. 18, 1992 has suggested an electrically insulating cover to which shield characteristic is provided.

FIGS. 3 and 4 illustrate the cover suggested in the above-mentioned Publication. FIG. 3 is a perspective view of the cover with portions cut away, and FIG. 4 is a perspective view of the cover, as viewed from downwardly.

As illustrated in FIG. 3, a piezoelectric electronic part P is mounted on a base B, and is covered with an electrically insulating cover C.

As illustrated in FIG. 4, the cover C is formed at an entire upper inner surface with a shield electrode C1, and at a part of side inner surfaces with shield electrodes C2. Furthermore, the cover C is formed at an external surface thereof with a external electrode C3 and a shield electrode C4. The shield electrodes C4 are designed to electrically connect with the shield electrodes C1 and C2. The reason why the cover C is formed at an external surface thereof with the external electrode C3 and the shield electrodes C4 is to use an electro-magnetic relay with the cover C, as a chip component.

However, the above-mentioned cover is accompanied with a problem that since the external electrode C3 is formed on an external surface of the cover C, it is impossible to ensure a high breakdown voltage between the cover C and the external electrode C3, or a high breakdown voltage between the shield electrodes C1 to C3 and the external electrode C3.

If the electrically insulating cover illustrated in FIGS. 3 and 4 were used for an electro-magnetic relay, there would be caused a big problem on safety that it is impossible to have a high breakdown voltage between a cover and coil terminals, and between a cover and contact terminals.

In addition, the cover C illustrated in FIGS. 3 and 4 is formed at just a part of an inner side surface thereof with the shield electrode C2, though the cover C is formed at an entire inner upper surface with the shield electrode C1. As a result, the cover C is accompanied with a problem of insufficient shield characteristic against electro-magnetic waves entering through a sidewall of the cover C.

SUMMARY OF THE INVENTION

In view of the above-mentioned problems of the conventional cover used for an electro-magnetic relay, it is an object of the present invention to provide an electro-magnetic relay having higher shield characteristic to thereby have improved response to high frequency input signals.

Another object of the present invention is to provide an electro-magnetic relay having sufficiently improved breakdown voltages between a cover and coil terminals, and between a cover and contact terminals.

It is also an object of the present invention to provide a cover to be used for the above-mentioned electro-magnetic relays.

In one aspect of the present invention, there is provided a cover used for an electro-magnetic relay, including (a) an enclosure having both a bottom edge defining an open bottom, and an insulating external surface, (b) a plurality of projections formed on the bottom edge so that the projections can support the enclosure while the enclosure stands, and (c) a shield metal film formed on an inner surface of the enclosure, the shield metal film extending to a bottom surface of each of the projections so that the bottom surface of each of the projections acts as a grounding surface.

Since the cover is designed to have a shield metal film on an inner surface thereof, the cover could have shield characteristic. Hence, it is possible to match with characteristic impedance of a transmission path, resulting in quicker response to high frequency input signals.

In addition, since the shield metal film is formed on a bottom surface of the projections, the projections can act as grounding surfaces. That is, the projections have two functions, one of which is to support the enclosure, and the other is to provide ground to the enclosure.

Furthermore, since the enclosure has an insulating external surface, it is possible to enhance a breakdown voltage between the enclosure and coil terminals of an electro-magnetic relay, and between the enclosure and contact terminals of an electro-magnetic relay.

It is preferable that the enclosure is formed at the inner surface thereof with an insulating region starting from the bottom edge and having a predetermined length.

The insulating region further enhances a breakdown voltage between the enclosure and coil terminals of an electro-magnetic relay, and between the enclosure and contact terminals of an electro-magnetic relay.

It is preferable that the shield metal film formed on the inner surface of the enclosure and the shield metal film formed on the bottom surface of each of the projections are connected through strip-shaped connecting films, and the strip-shaped connecting films are arranged to be equally spaced away from adjacent terminals of the electro-magnetic relay when the cover is attached to the electro-magnetic relay.

The enclosure is preferably made of electrically insulating material.

It is preferable that projections have the same height and/or the same shape. It is also preferable that the projections have an arcuate shape. Each of the projections may be designed to have a planar portion at a distal end thereof.

It is preferable that the bottom edge of the enclosure has first and second bottom edge portions facing to each other, and that some of the projections are formed on the first bottom edge portion, and other projections are formed on the second bottom edge portion, in which case, the some of the projections are preferably arranged mirror-symmetrical with the other projections.

For instance, the enclosure may be box-shaped, in which case, it is preferable that the shield metal film is at least partially formed on all inner side surfaces of the enclosure.

Since the enclosure is formed at all inner side surfaces thereof with the shield metal film, shield characteristic of the enclosure is strengthened. Above all, it is possible to effectively interrupt electro-magnetic waves from entering through a sidewall of the enclosure.

There is further provided a cover used for an electro-magnetic relay, including (a) an enclosure having both a bottom edge defining an open bottom, and an insulating external surface, (b) a plurality of projections formed on the bottom edge so that the projections can support the enclosure while the enclosure stands, and (c) a shield metal plate covering an inner surface of the enclosure therewith, the shield metal plate having extensions extending along and beyond the projections.

An electro-magnetic relay including the above-mentioned cover can be mounted on a substrate with the extensions of the shield metal plate being inserted into through-holes formed through the substrate.

In another aspect of the present invention, there is provided an electro-magnetic relay including (a) a coil assembly including a core, a coil wound around the core, and a magnet located at the center of the core, (b) an armature block assembly including an armature swingable relative to the core, a spring swingable together with the armature and having a contact at a distal end thereof, and an insulating block formed integral with the armature and the spring, (c) a base assembly including a fixed contact facing to the spring, a fixed contact terminal on which the fixed contact is formed, a neutral terminal to be electrically connected to the spring, a coil terminal to be electrically connected to the coil, and an insulating block formed integral with the fixed contact terminal, the neutral terminal, and the coil terminal, and (d) a cover housing therein the coil assembly, the armature block assembly, and the base assembly, the cover having such a structure as mentioned above.

It is preferable that the electro-magnetic relay further includes an electrically insulating sealing layer formed between the enclosure and the fixed contact terminal, the neutral terminal, and the coil terminal.

The electrically insulating sealing film fixes positional relation between the enclosure and the terminals, resulting in higher reliability against oscillation and impact.

It is preferable that the shield metal film formed on the inner surface of the enclosure and the shield metal film formed on the bottom surface of each of the projections are connected through strip-shaped connecting films, and the strip-shaped connecting films are spaced away from the fixed contact terminal, neutral terminal, or coil terminal at least by 0.5 mm when the cover is attached to the electro-magnetic relay.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

FIGS. 5 to 9 illustrate a cover to be used for an electro-magnetic relay, in accordance with the first embodiment. The cover in accordance with the first embodiment is used to cover therewith a relay assembly comprised of the coil assembly 100, the armature block assembly 200, and the base assembly 300 all illustrated in FIGS. 1 and 2.

Figure 5:
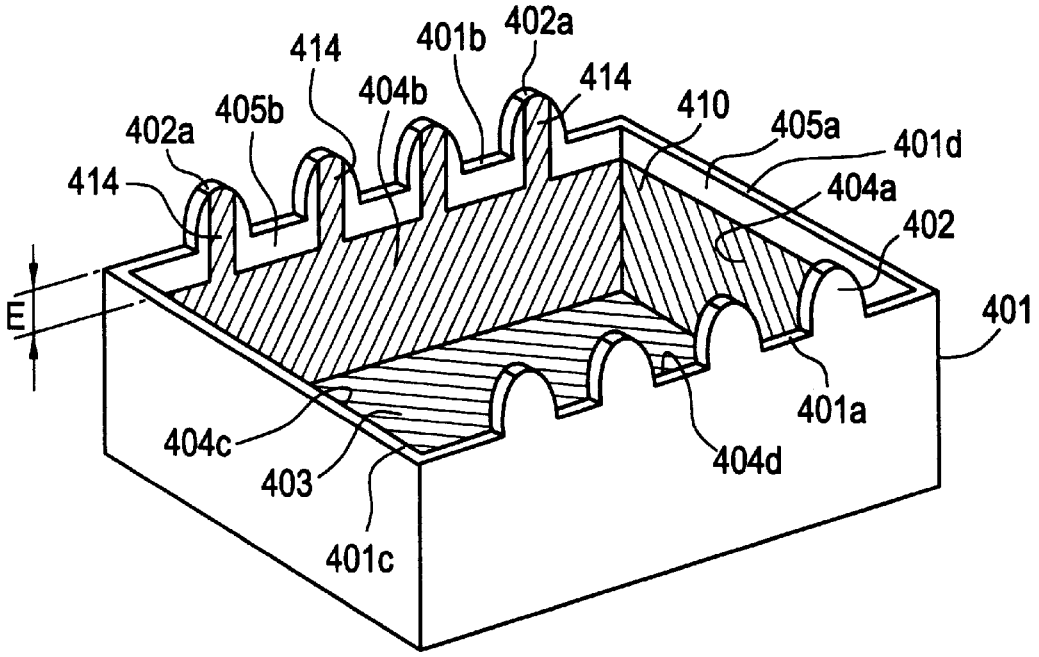
FIG. 5 is a perspective view of the cover in accordance with the first embodiment of the present invention, illustrating the cover upside down.

FIG. 5 is a perspective view of the cover in accordance with the first embodiment. It should be noted that the cover is illustrated upside down in FIG. 1 in order to sufficiently show an internal structure.

The illustrated cover is comprised of a box-shaped enclosure 401 having a bottom edge defining an open bottom, eight projections 402 formed on the bottom edge, and a shield metal film 410 formed on an inner surface of the enclosure 401.

The enclosure 401 is made of electrically insulating material, and has an insulating external surface. The bottom edge of the enclosure 401 is comprised of first, second, third, and fourth bottom edge portions 401*a*, 401*b*, 401*c*, and 401*d*. The first and second bottom edge portions 401*a* and 401*b* face to each other in parallel, and the third and fourth bottom edge portions 401*c* and 401*d* face to each other in parallel.

The projections 402 are formed both on the first and second bottom edge portions 401*a* and 401*b* so that the projections 402 formed on the first bottom edge portion 401*a* are mirror-symmetrical with the projections 402 formed on the second bottom edge portion 401*b*.

Figure 8:
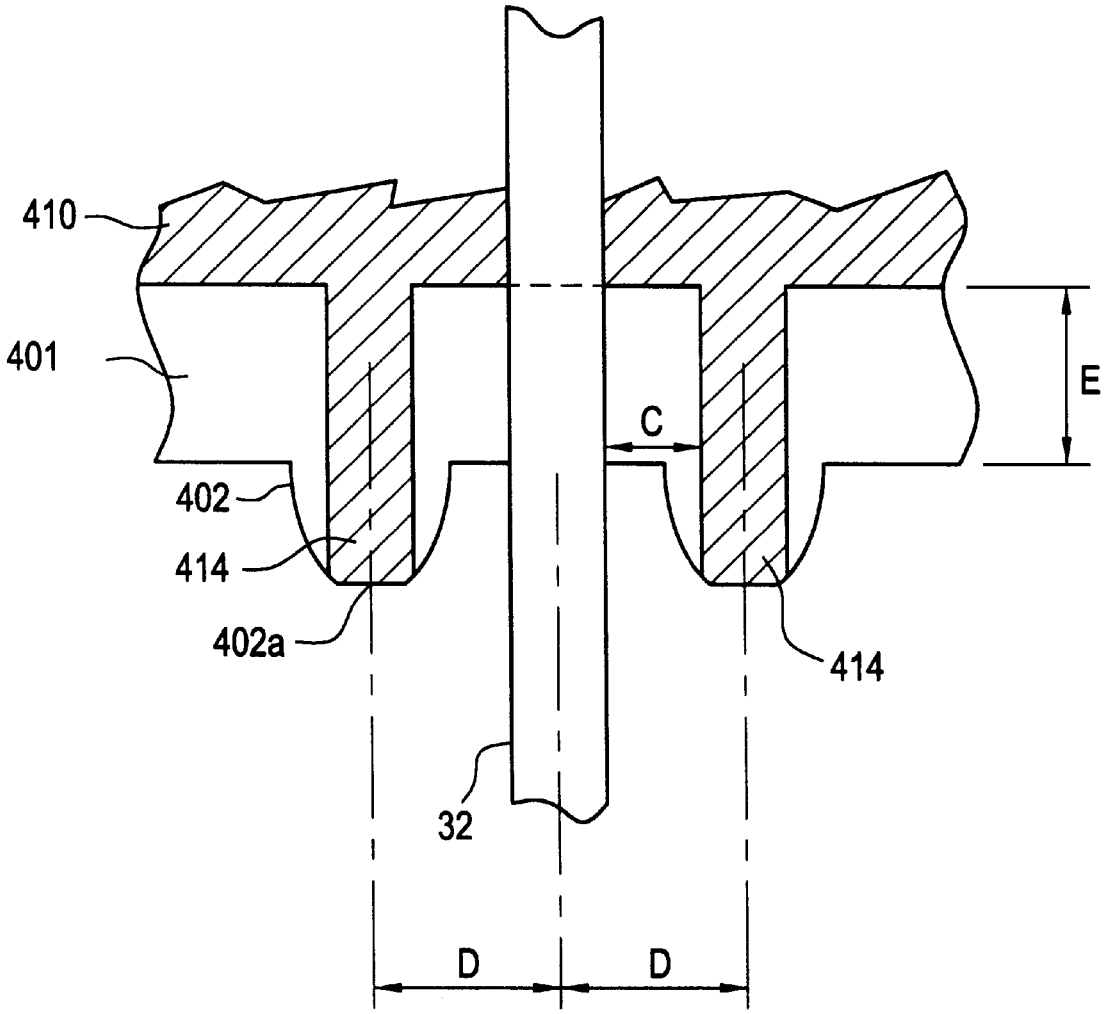
FIG. 8 is an enlarged view illustrating a fixed contact terminal and projections.

The projections 402 are equally spaced away from adjacent ones on the first and second bottom edge portions 401*a* and 401*b*. The projections 402 have the same shape. Specifically, the projections 402 have an arcuate shape, and have a planar bottom portion 402*a* at a distal end thereof, as best shown in FIG. 8.

Figure 9:
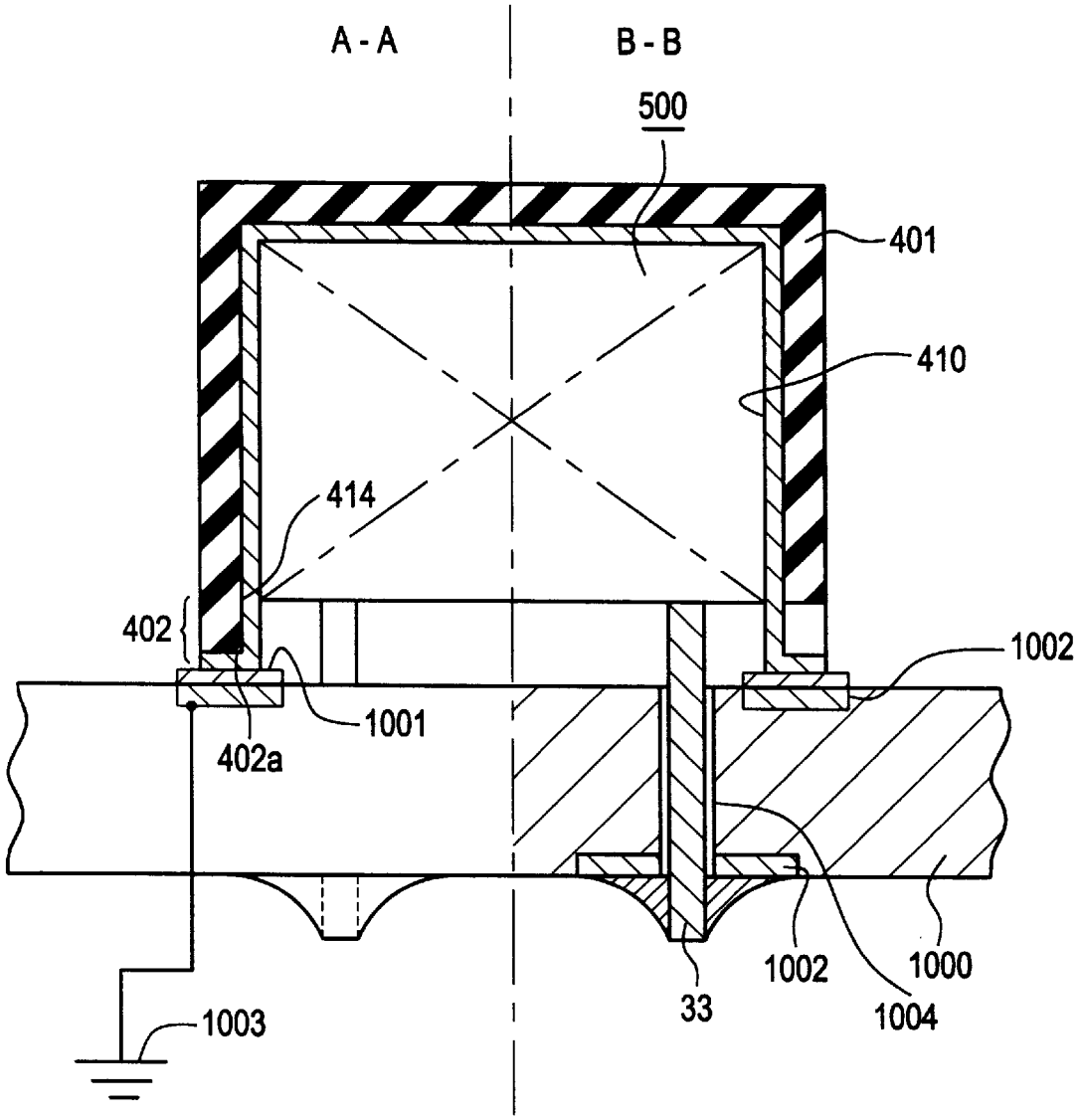
FIG. 9 is a cross-sectional view of the electro-magnetic relay mounted on a printed wiring board, taken along the lines A—A (left half) and B—B (right half) in FIG. 6.

The projections 402 support the enclosure 401 to stand on a substrate 1000, for instance, as illustrated in FIG. 9.

The enclosure 401 is formed an entire upper inner surface 403 with the shield metal film 410 by evaporation. In addition, the enclosure is formed at all inner side surfaces 404*a*, 404*b*, 404*c*, and 404*d* with the shield metal film 410. The shield metal film 410 formed on the inner side surfaces 404*a*, 404*b*, 404*c*, and 404*d* terminates short of the bottom edge. That is, the enclosure 401 is formed at all inner side surfaces 404*a*, 404*b*, 404*c*, and 404*d* with insulating regions 405*a*, 405*b*, 405*c*, and 405*d* (only the insulating regions 405*a* and 405*b* are illustrated in FIG. 5) starting from the bottom edge and having a length E.

The shield metal film 410 is also formed on the planar bottom portions 402*a* of the projections 402. The shield metal film 410 formed on the planar bottom portions 402*a* and the shield metal film 410 formed on the inner side surfaces of the enclosure 401 are connected through strip-shaped connecting films 414. That is, the shield metal film 410 extends to the planar bottom portions 402*a* of the projections 402. Thus, the bottom surfaces 402*a* of the projections 402 can act as a grounding surface.

Figure 1:
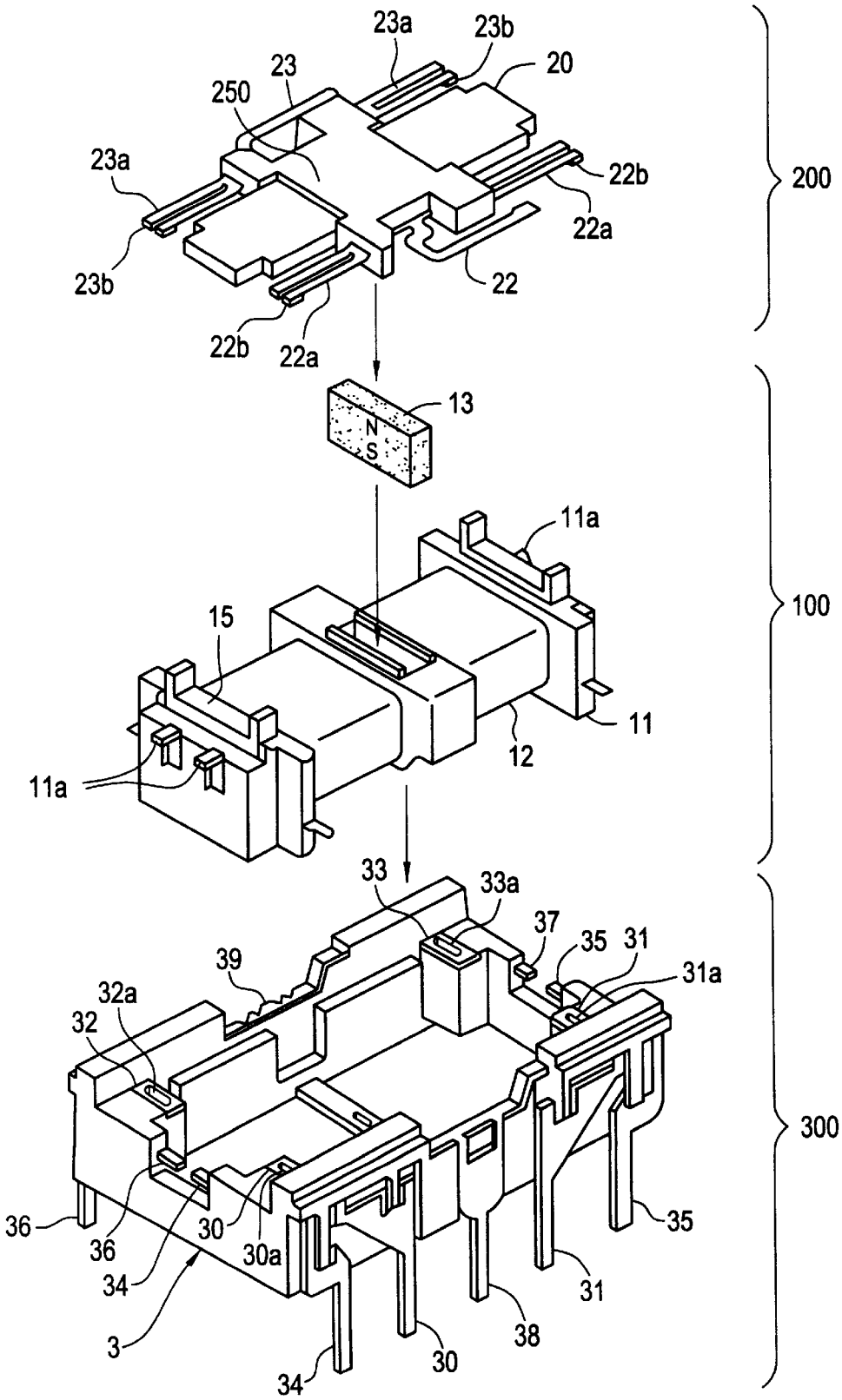
FIG. 1 PRIOR ART
FIG. 1 is an exploded perspective view illustrating a conventional electro-magnetic relay.
Figure 2:
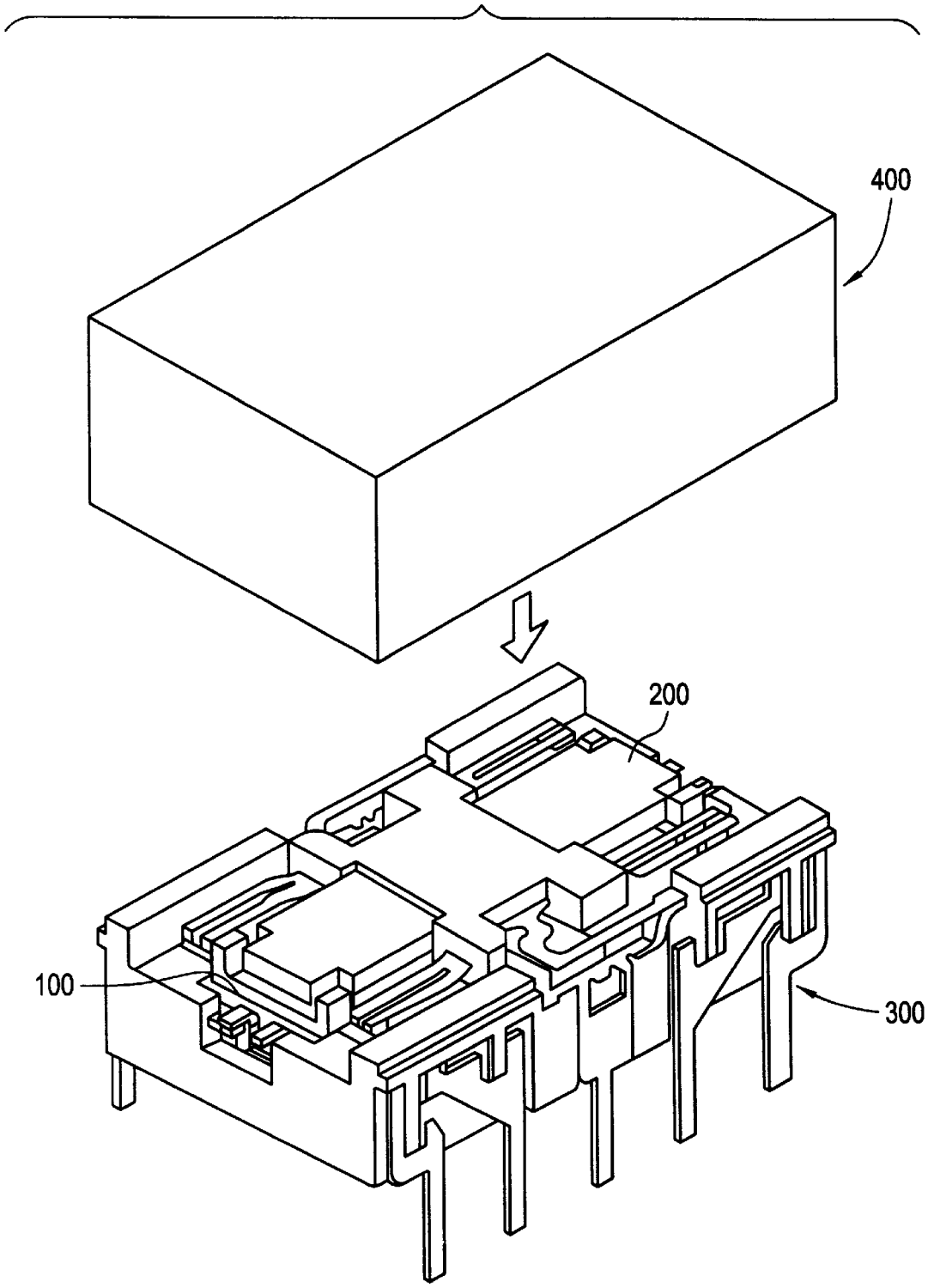
FIG. 2 PRIOR ART
FIG. 2 is perspective view of the electro-magnetic relay illustrated in FIG. 1 and a cover to be attached to the electro-magnetic relay.
Figure 3:
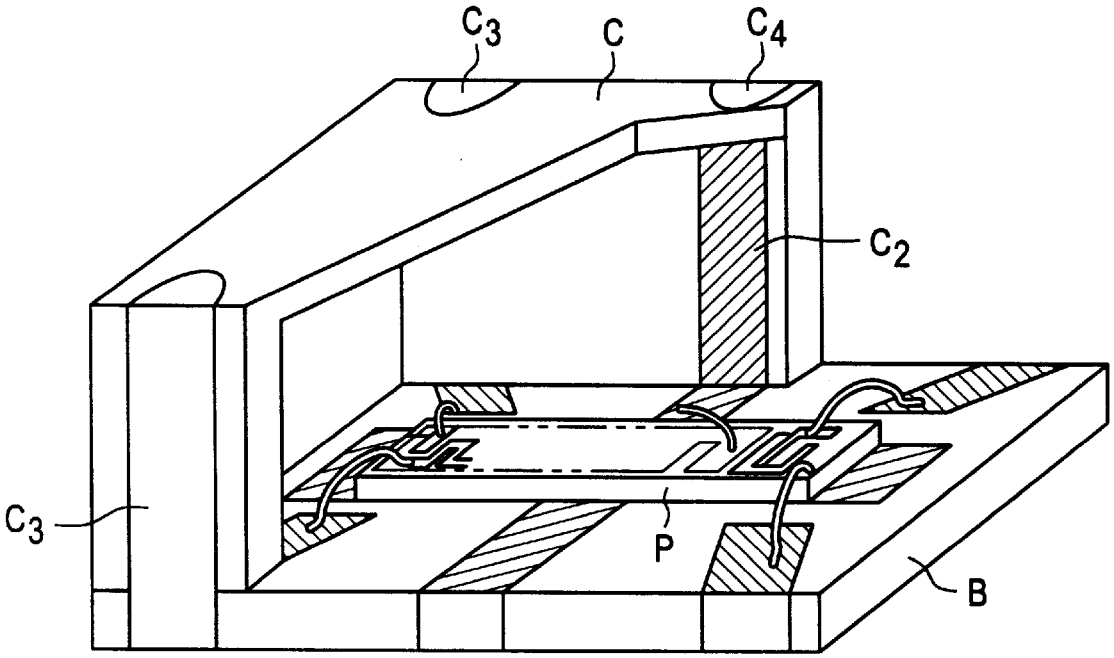
FIG. 3 PRIOR ART
FIG. 3 is a perspective view of an electrically insulating cover having shield characteristic with some portions cut away.
Figure 4:
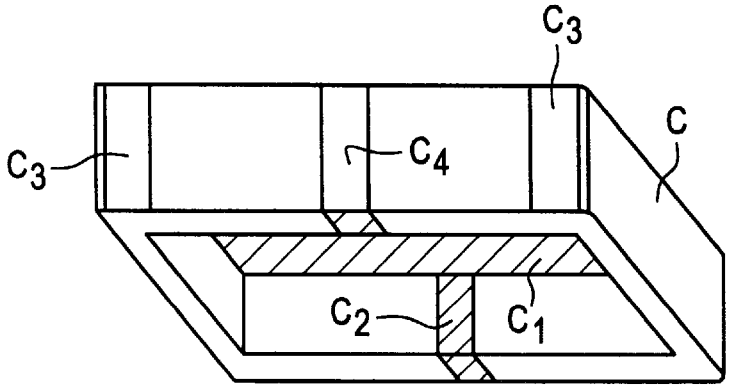
FIG. 4 PRIOR ART
FIG. 4 is a perspective view of the cover illustrated in FIG. 3, as viewed from downwardly.
Figure 6:
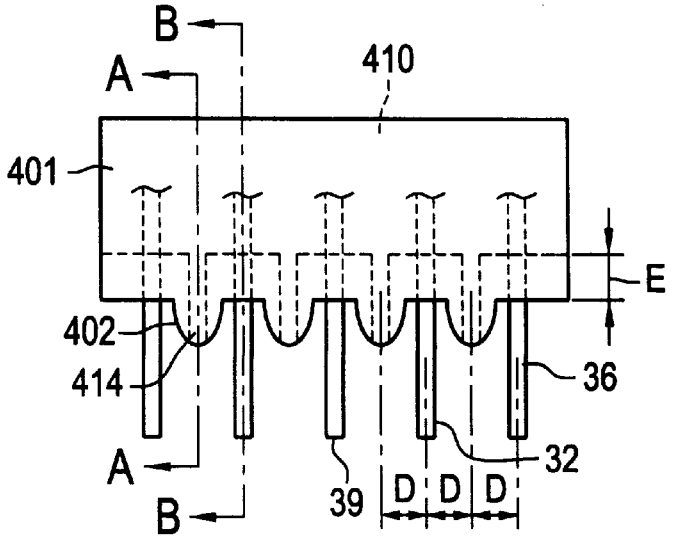
FIG. 6 is a side view of the cover illustrated in FIG. 5.

As illustrated in FIG. 6, the strip-shaped connecting films 414 are arranged to be equally spaced away from adjacent fixed contact terminals 30, 31, 32, and 33, coil terminals 34, 35, 36, and 37, and neutral terminals 38 and 39, when the cover is attached to the relay assembly comprised of the coil assembly 100, the armature block assembly 200, and the base assembly 300 all illustrated in FIGS. 1 and 2. Supposed that those adjacent terminals are spaced away from each other by a distance 2D, the strip-shaped connecting films 414 are spaced away from adjacent one by a distance 2D. In other words, the strip-shaped connecting film 414 is spaced away from an adjacent terminal by a distance D.

Figure 7:
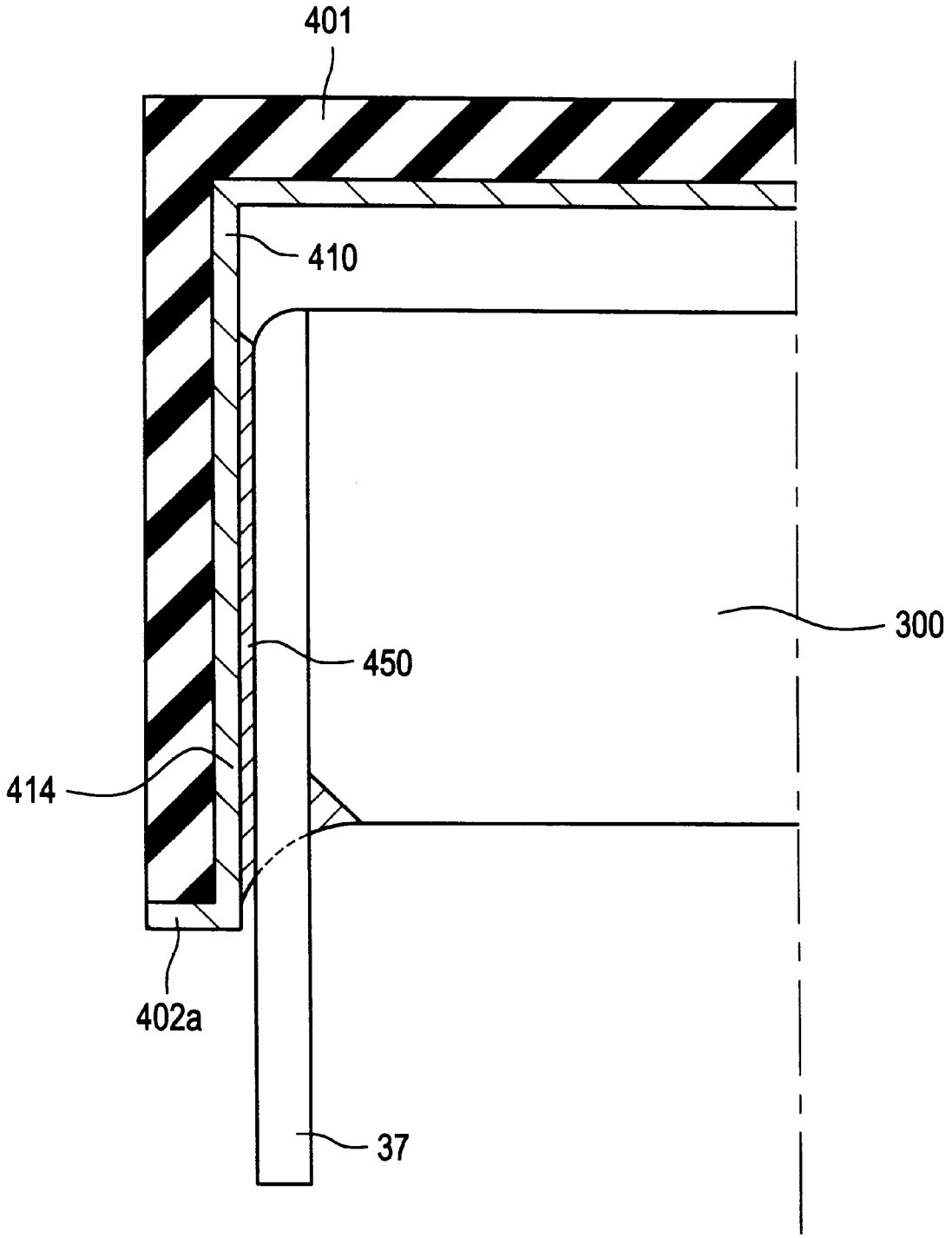
FIG. 7 is a cross-sectional view taken along the line A—A in FIG. 6.

FIG. 7 is a cross-sectional view taken along the line A—A in FIG. 6. As illustrated in FIG. 7, an electrically insulating sealing layer 450 is formed between the enclosure 401 and each of the fixed contact terminals 30–33, coil terminals 34–37, and the neutral terminals 38 and 39. The electrically insulating sealing layer 450 is composed of epoxy resin, for instance. The electrically insulating sealing layer 450 is formed by injecting a liquid-phase sealing material into a gap between the enclosure 401 and a terminal, and curing the liquid-phase sealing material, for instance. The electrically insulating sealing layer 450 electrically insulates the shield metal film 410 from the terminals.

FIG. 8 illustrates the fixed contact terminal 32 located between the projections 402. As mentioned earlier, the shield metal film 410 extends to the planar bottom portions 402*a* through the strip-shaped connecting films 414. The adjacent strip-shaped connecting films 414 between which the fixed contact terminal 32 is located are spaced away from each other by a distance 2D. Hence, the strip-shaped connecting film 414 is spaced away from the adjacent fixed contact terminal 32 by a distance D.

FIG. 9 is a cross-sectional view of the electro-magnetic relay mounted on a printed wiring board, taken along the lines A—A (left half) and B—B (right half) in FIG. 6. A relay assembly 500 comprised of the coil assembly 100, the armature block assembly 200, and the base assembly 300 all illustrated in FIGS. 1 and 2 is covered by the cover in accordance with the first embodiment.

A printed wiring board 1000 is formed at upper and lower surfaces thereof with a wiring pattern 1002. Solder pads 1001 are mounted on the printed wiring board 1000. The electro-magnetic relay is mounted on the printed wiring board 1000 so that the planar bottom portion 402*a* of the projections 402, acting as a ground surface, makes contact with the solder pad 1001, resulting in that the shield metal film 410 is electrically connected to an earth 1003.

As illustrated in FIG. 9, when the electro-magnetic relay is mounted on the printed wiring board 1000, the fixed contact terminal 33 is inserted into a through-hole 1004 formed throughout the printed wiring board 1000.

In accordance with the electro-magnetic relay having the abovementioned structure, the shield metal film 410 formed on an inner surface of the enclosure 401 provides shield characteristic to the cover. As a result, it is possible for the electro-magnetic relay to match with characteristic impedance of a transmission path, which makes it possible to more quickly respond to high frequency input signals.

In addition, the shield metal film 410 formed on the planar bottom portion 402*a* of the projections 402 makes it possible for the projections 402 to act as a grounding surface. That is, the projections 402 double as a support for the electro-magnetic relay and an earth.

Furthermore, since the enclosure 401 has an insulating external surface, it is possible to enhance a breakdown voltage between the cover and the coil terminals, and between the cover and the contact terminals.

The insulating regions 405*a*, 405*b*, 405*c*, and 405*d* formed on the inner side surfaces 404*a*, 404*b*, 404*c*, and 404*d* and having a length E measured from the bottom edge of the enclosure 401 further enhances a breakdown voltage between the cover and the coil terminals, and between the cover and the contact terminals.

In addition, the shield metal film 410 formed at least partially on all the inner side surfaces 404*a*, 404*b*, 404*c*, and 404*d* of the enclosure 401 provides enhanced shield characteristic to the cover. Above all, it is possible to strengthen shield characteristic for preventing electro-magnetic waves from entering the over through a sidewall of the enclosure 401.

Furthermore, since the strip-shaped connecting films 414 are arranged o be equally spaced away from adjacent terminals such as the fixed contact terminals 30 to 33, the neutral terminals 38 and 39, and the coil terminals 34 to 37, a breakdown voltage between the cover and the terminals can be further enhanced.

The electrically sealing layer 450 such as epoxy resin formed between the enclosure 401 and the fixed contact terminals 30 to 33, the neutral terminals 38 and 39, or the coil terminals 34 to 37 fixes the positional relation between the enclosure 401 and those terminals, which enhances oscillation-proof and impactproof.

In the first embodiment, supposed that a minimum distance along an inner surface of the enclosure 401 between the strip-shaped connecting film 414 and the fixed contact terminals 30 to 33, the neutral terminals 38 and 39, or the coil terminals 34 to 37 is indicated as C, the distance C, the distance D, and the length E are determined under the following relations.

$C<D$ and $C<E$

Based on the results of the experiments which the inventor had conducted, a practical breakdown voltage of 500 V can be obtained, if the distance C is equal to or greater than 0.5 mm ($C \geqq 0.5$ mm). Hence, it is preferable to set the distance C equal to or greater than 0.5 mm for ensuring a practical breakdown voltage of 500 V between the cover and fixed contact terminals, and between the cover and the coil terminals.

Second Embodiment

Figure 10:
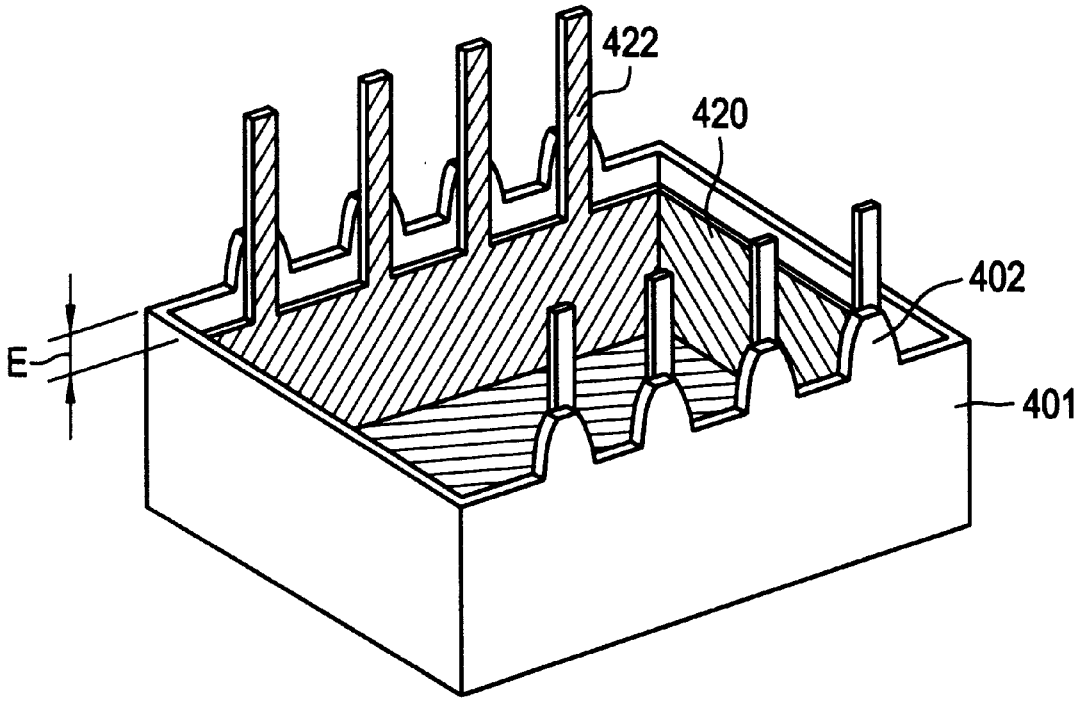
FIG. 10 is a perspective view of the cover in accordance with the second embodiment of the present invention, illustrating the cover upside down.
Figure 11:
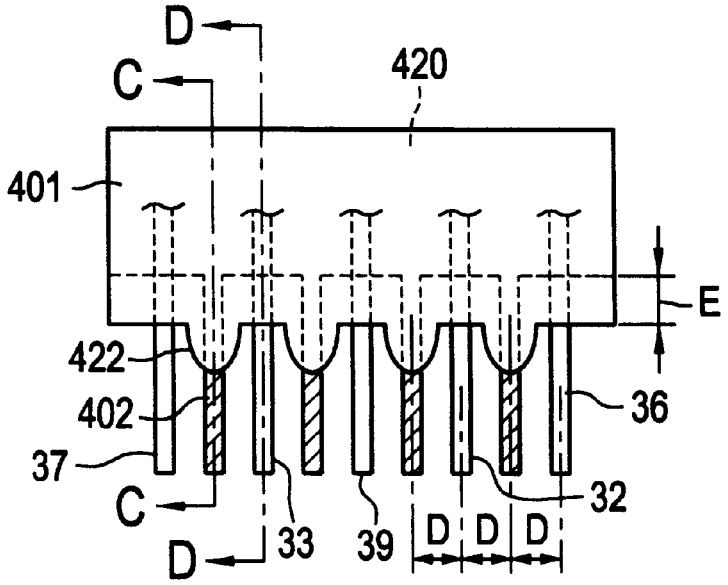
FIG. 11 is a side view of the cover illustrated in FIG. 10.

FIG. 10 is a perspective view of the cover in accordance with the second embodiment. Similarly to FIG. 5, the cover is illustrated upside down for clarifying an internal structure of the cover. FIG. 11 is a side view of the cover illustrated in FIG. 10.

The illustrated cover is comprised of an enclosure 401 having a bottom edge defining an open bottom, and also having an insulating external surface, a plurality of projections 402 formed on the bottom edge of the enclosure 401, and a shield metal plate 420 covering an inner surface of the enclosure 401 therewith, and having extensions 422 extending along and beyond the projections 402.

The enclosure 401 in the second embodiment has the same structure as that of the enclosure 401 in the first embodiment. Similarly, the projections 402 in the second embodiment have the same structure as that of the projections 402 in the first embodiment. The cover in the second embodiment is different from the cover in the first embodiment in that the shield metal film 410 is replaced with the shield metal plate 420, and the strip-shaped connecting films 414 and the shield metal films 410 formed on the planar bottom portions 402*a* of the projections 402 are replaced with the extensions 422 of the shield metal plate 420.

In the second embodiment, the extensions 422 have the same length and the same width.

Figure 12:
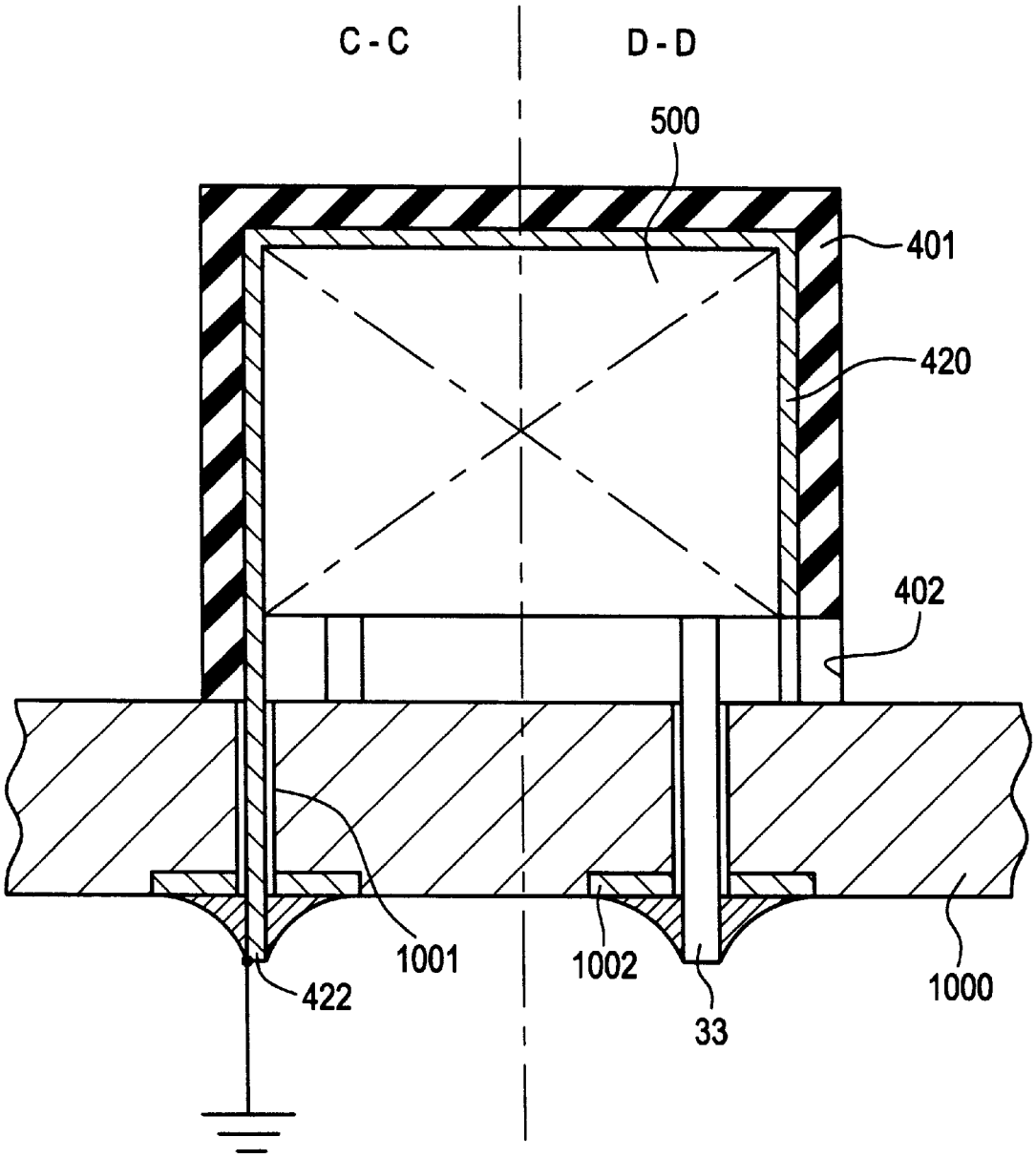
FIG. 12 is a cross-sectional view of the electro-magnetic relay mounted on a printed wiring board, taken along the lines C—C (left half) and D—D (right half) in FIG. 11.

FIG. 12 is a cross-sectional view of an electro-magnetic relay including the cover in accordance with the second embodiment, taken along the lines C—C (left half) and D—D (right half) in FIG. 11. As illustrated in FIG. 12, an electro-magnetic relay including the cover in accordance with the second embodiment is mounted on a printing wiring board 1000 with the extensions 422 of the shield metal plate 420 being inserted into a through-hole 1001 formed through the printed wiring board 1000.

In the above-mentioned embodiments, a distance between the projection 402 and an adjacent terminal is not to be limited to the distance D. However, when a distance between the projection 402 and an adjacent terminal is equal to D, the distance C could be preferably maximized.

The shape, number, size, and location of the projections 402 are not to be limited to those shown in the embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-306072 filed on Nov. 7, 1997 including specification, claims, drawings and summary is incorporated herein by reference in its entirety.

What is claimed is:

1. A cover used for an electro-magnetic relay, comprising:

(a) an enclosure having both a bottom edge defining an open bottom, and an insulating external surface;

(b) a plurality of projections formed on said bottom edge so that said projections can support said enclosure while said enclosure stands; and (c) a shield metal film formed on an inner surface of said enclosure, said shield metal film extending to a bottom surface of each of said projections so that said bottom surface of each of said projections acts as a grounding surface.

2. The cover as set forth in claim 1, wherein said enclosure is formed at said inner surface thereof with an insulating region starting from said bottom edge and having a predetermined length.

3. The cover as set forth in claim 1, wherein said shield metal film formed on said inner surface of said enclosure and said shield metal film formed on said bottom surface of each of said projections are connected through strip-shaped connecting films, and said strip-shaped connecting films are arranged to be equally spaced away from adjacent terminals of said electro-magnetic relay when said cover is attached to said electro-magnetic relay.

4. The cover as set forth in claim 1, wherein said enclosure is made of electrically insulating material.

5. The cover as set forth in claim 1, wherein said projections have the same height.

6. The cover as set forth in claim 1, wherein said projections have the same shape.

7. The cover as set forth in claim 1, wherein said projections have an arcuate shape.

8. The cover as set forth in claim 1, wherein each of said projections has a planar portion at a distal end thereof.

9. The cover as set forth in claim 1, wherein said bottom edge of said enclosure has first and second bottom edge portions facing to each other, and some of said projections are formed on said first bottom edge portion, and other projections are formed on said second bottom edge portion.

10. The cover as set forth in claim 9, wherein said some of said projections are arranged mirror-symmetrical with said other projections.

11. The cover as set forth in claim 1, wherein said enclosure is box-shaped.

12. The cover as set forth in claim 11, wherein said shield metal film is at least partially formed on all inner side surfaces of said enclosure.

13. An electro-magnetic relay comprising:

(a) a coil assembly including a core, a coil wound around said core, and a magnet located at the center of said core;

(b) an armature block assembly including an armature swingable relative to said core, a spring swingable together with said armature and having a contact at a distal end thereof, and an insulating block formed integral with said armature and said spring;

(c) a base assembly including a fixed contact facing to said spring, a fixed contact terminal on which said fixed contact is formed, a neutral terminal to be electrically connected to said spring, a coil terminal to be electrically connected to said coil, and an insulating block formed integral with said fixed contact terminal, said neutral terminal, and said coil terminal; and (d) a cover housing therein said coil assembly, said armature block assembly, and said base assembly, said cover comprising:

(d1) an enclosure having both a bottom edge defining an open bottom, and an insulating external surface;

(d2) a plurality of projections formed on said bottom edge so that said projections can support said enclosure while said enclosure stands; and (d3) a shield metal film formed on an inner surface of said enclosure, said shield metal film extending to a bottom surface of each of said projections so that said bottom surface of each of said projections acts as a grounding surface.

14. The electro-magnetic relay as set forth in claim 13, wherein said enclosure is formed at said inner surface thereof with an insulating region starting from said bottom edge and having a predetermined length.

15. The electro-magnetic relay as set forth in claim 13, wherein said shield metal film formed on said inner surface of said enclosure and said shield metal film formed on said bottom surface of each of said projections are connected through strip-shaped connecting films, and said strip-shaped connecting films are arranged to be equally spaced away from adjacent fixed contact terminals, neutral terminals, or coil terminals when said cover is attached to said electro-magnetic relay.

16. The electro-magnetic relay as set forth in claim 13, wherein said enclosure is made of electrically insulating material.

17. The electro-magnetic relay as set forth in claim 13, wherein said projections have the same height.

18. The electro-magnetic relay as set forth in claim 13, wherein said projections have the same shape.

19. The electro-magnetic relay as set forth in claim 13, wherein said projections have an arcuate shape.

20. The electro-magnetic relay as set forth in claim 13, wherein each of said projections has a planar portion at a distal end thereof.

21. The electro-magnetic relay as set forth in claim 13, wherein said bottom edge of said enclosure has first and second bottom edge portions facing to each other, and some of said projections are formed on said first bottom edge portion, and other projections are formed on said second bottom edge portion.

22. The electro-magnetic relay as set forth in claim 21, wherein said some of said projections are arranged mirror-symmetrical with said other projections.

23. The electro-magnetic relay as set forth in claim 13, wherein said enclosure is box-shaped.

24. The electro-magnetic relay as set forth in claim 23, wherein said shield metal film is at least partially formed on all inner side surfaces of said enclosure.

25. The electro-magnetic relay as set forth in claim 13, further comprising an electrically insulating sealing layer formed between said enclosure and said fixed contact terminal, said neutral terminal, and said coil terminal.

26. The electro-magnetic relay as set forth in claim 13, wherein said shield metal film formed on said inner surface of said enclosure and said shield metal film formed on said bottom surface of each of said projections are connected through strip-shaped connecting films, and said strip-shaped connecting films are spaced away from said fixed contact terminal, neutral terminal, or coil terminal at least by 0.5 mm when said cover is attached to said electro-magnetic relay.

* * * * *